United States Patent [19]

Merrien et al.

[11] 4,427,443

[45] Jan. 24, 1984

[54] PROCESS AND APPARATUS FOR AUTOMATING A VACUUM DEGASIFICATION CYCLE FOR METAL ALLOYS

[75] Inventors: Pierre L. Merrien, Billere; Pierre A. Merrien, Sceaux, both of France

[73] Assignee: Etude et Developpement en Metallurgie, Billere, France

[21] Appl. No.: 210,622

[22] Filed: Nov. 26, 1980

[30] Foreign Application Priority Data

Nov. 28, 1979 [FR] France ..... 79 29226

[51] Int. Cl.[3] ..... C22B 9/04

[52] U.S. Cl. ..... 75/68 R; 75/10 V; 75/93 AC

[58] Field of Search ..... 75/93 E, 93 AC, 68 R, 75/10 V; 266/87, 79, 89, 96, 211, 207–210

[56] References Cited

U.S. PATENT DOCUMENTS

| | | | |
|---|---|---|---|
| 3,352,665 | 11/1967 | Stonkuist et al. | 675/49 |
| 3,594,155 | 7/1971 | Ramachandran | 75/60 |
| 3,635,696 | 1/1972 | Finkl | 75/11 |
| 3,700,429 | 10/1972 | Ramachandran | 75/49 |
| 3,958,981 | 5/1976 | Forberg | 75/68 R |
| 4,003,560 | 1/1977 | Carbonnel | 266/217 |

*Primary Examiner*—L. Dewayne Rutledge

*Assistant Examiner*—Christopher W. Brody

*Attorney, Agent, or Firm*—Sandler & Greenblum

[57] ABSTRACT

Apparatus and process for automating a vacuum degasification cycle for metal alloys, particularly aluminum alloys. The process comprises adjusting the degasification speed to sequentially correspond to a plurality of sets of degasification speed parameters. Each set of degasification speed parameters corresponds to a predetermined desired degasification speed. The degasification speed may be adjusted by adjusting the vacuum surrounding the alloy. The degasification speed is triggered to change from corresponding to one set of parameters to another set of parameters by the sensing of a series of predetermined partial pressures of gas in the alloy. The apparatus includes an inlet-outlet assembly for transforming given indications into a numerical form for the parameters of the degasification cycle and a calculator assembly adapted to transform the speed of degasification into variations of theoretical partial pressure and to regulate the pressure in the enclosure of the furnace to obtain an identical variation to that required based upon the indications of the standard curve placed in the assembly memories. Several furnaces may be regulated. The temperature of the metal may be regulated at a level equivalent to that required before casting. The apparatus can include a microprocessor.

20 Claims, 4 Drawing Figures

PROCESS AND APPARATUS FOR AUTOMATING A VACUUM DEGASIFICATION CYCLE FOR METAL ALLOYS

FIELD OF THE INVENTION

The present invention relates generally to the degasification under vacuum of aluminum alloys and the regulation thereof.

BACKGROUND OF THE INVENTION

It is known that aluminum alloys dissolve gas, and, in particular, hydrogen gas. These gases are less soluble when the metal is in the solid phase than in the liquid phase and can be released during solidification of the metal to yield micropores.

Three general processes exist for diminishing the level of gas, in particular hydrogen gas, in aluminum alloys. One process is to perform a chemical degasification by introducing into the metal products which decompose to give off an element which will combine with the hydrogen gas. For example, $Cl_2$ to give HCL, with the chlorine being in the form of nascent chlorine. Another process is to perform a physical degasification by bubbling a gas, for example, nitrogen, argon, or chlorine, into the liquid aluminum alloy. Because the partial pressure of the hydrogen in the gas bubbles is less than that of the hydrogen in the metal, the hydrogen in the metal will diffuse into the bubble. The third general process is to perform a degasification under vacuum. In this process the aluminum is introduced into a sealed oven to which a vacuum is applied, or into a covered crucible in which a vacuum is created. The level of residual vacuum can be from 1–30 millibars. The vacuum is removed after a predetermined time such that the solidification under vacuum of an ingot collected in the metal after operation is satisfactory as determined by concavity of the surface, measure of the density, and radiographic slice. If the result is determined to be unsatisfactory, the degasification is resumed.

SUMMARY OF THE INVENTION

It is one object of the present invention to provide for degasification under vacuum in a plurality of predetermined initial phases where each phase has a predetermined degasification speed.

It is yet another object of the present invention to provide for degasification under vacuum of metal alloys in which a predetermined partial pressure is obtained in a fourth final maintenance phase.

It is still another object of the present invention to provide for automatic regulation of degasification of metal alloys under vacuum.

Another object of the present invention is to provide for agitation of the mass of the metal during degasification.

It is another object of the present invention to provide for degasification of an aluminum alloy under vacuum, where the aluminum alloy is a silicated alloy, such as not to destroy the modification of the silicon.

DETAILED DESCRIPTION OF THE DRAWINGS

Figure 1:
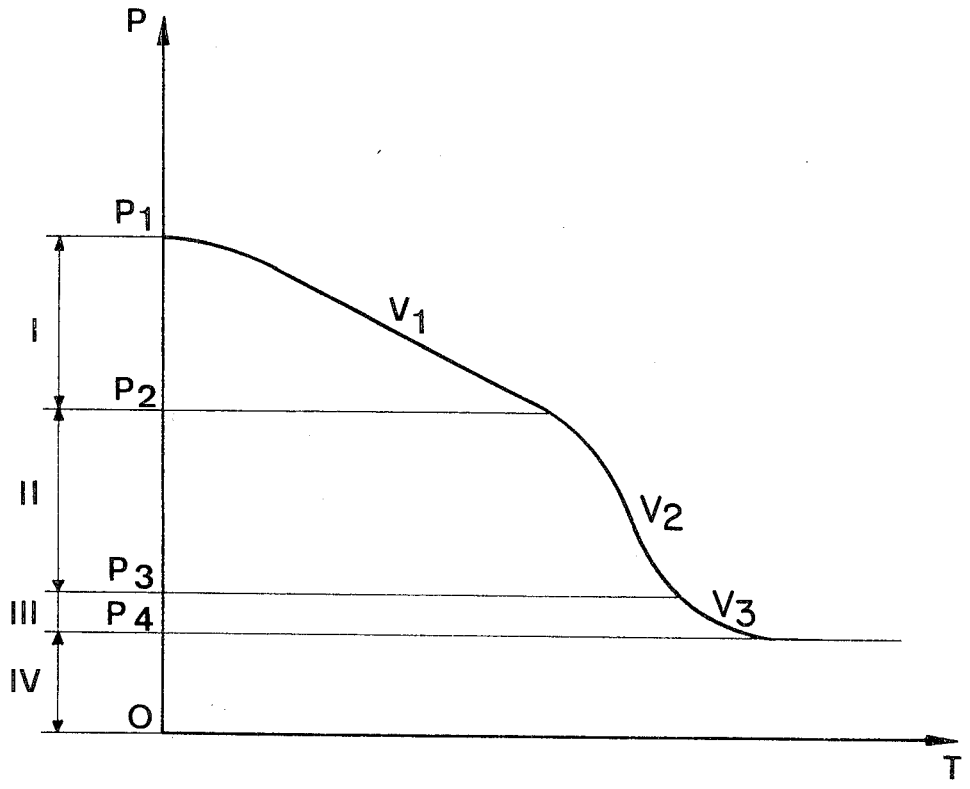
FIG. 1 is a graph of the desired partial pressure of hydrogen in the aluminum alloy under vacuum versus time, showing the different degasification speeds of the degasification phases.

FIG. 1 illustrates the degasification cycle of the instant invention in which degasification is expressed by the partial pressure of hydrogen in the metal as a function of time. It has been found, in effect, that the degasification must be carried out according to the diagram of FIG. 1. In phase 1, degasification is performed at a slow speed $V_1$, chosen so as to avoid bubbling leading to the creation of oxides where the pressure in the container is such as to develop a partial pressure of oxygen which is too substantial. Allowing bubbling would likewise result in the elimination of sodium introduced to assure the modification of the form of the silicon in the alloy in the case of silicated alloys.

In phase 2 as shown in FIG. 1, when a partial pressure of hydrogen in the aluminum alloy equal to $P_2$ is achieved, degasification is performed at a fast speed $V_2$ until the partial pressure has dropped to a predetermined partial pressure $P_3$. Bubbling will have been avoided by the passage of the partial pressure of hydrogen from $P_1$ to $P_2$.

In phase 3 as shown in FIG. 1, when a partial pressure of hydrogen has reached predetermined pressure level $P_3$, degasification is performed at a slow speed $V_3$ until a partial pressure of hydrogen equal to $P_4$ is reached, so as to subsequently enable the establishment of a null speed.

In phase 4 as shown in FIG. 1, when the partial pressure of hydrogen in the metal has reached a level equal to $P_4$, a null speed is established in order to preserve in the aluminum metal a residual partial pressure of hydrogen.

It has in effect appeared that, when too low a level of hydrogen exists in the metal, defects, generally in the form of marked cavities in the radius of attachment or of shrinkage cracks, appear during the course of the solidification due to localization of the hydrogen instead of a dispersion of the hydrogen.

Figure 2:
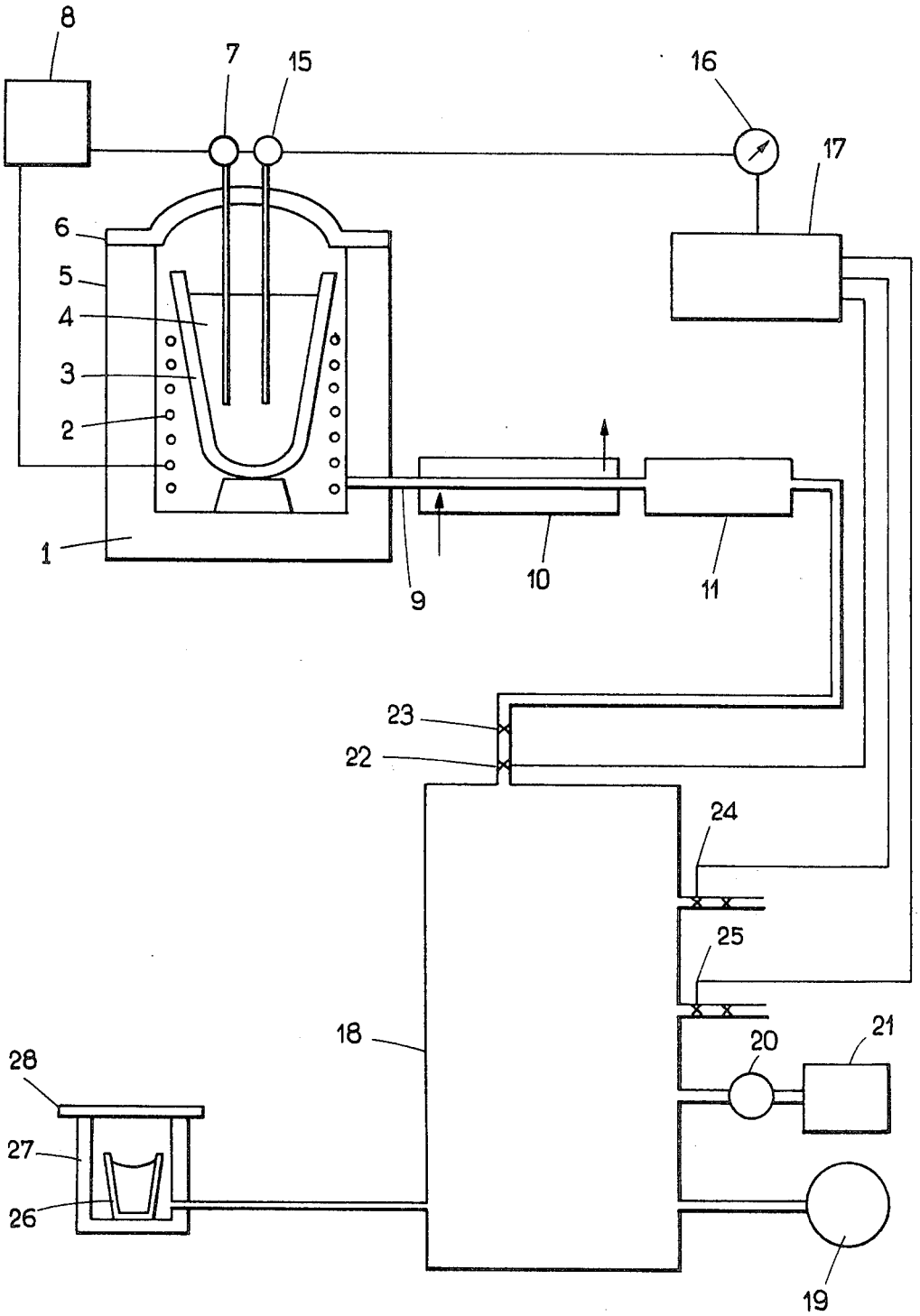
FIG. 2 is a schematic diagram of the apparatus of the instant invention.

FIG. 2 illustrates a sealed furnace 1 which provides for heating by induction in order to maintain a temperature, in general of approximately 750° C., and to provide for movement of the liquid metal to renew the layers in contact with the vacuum. The furnace includes an inductor 2, a crucible 3, and a cover 5. The metal 4 is placed in the crucible 3. Junction 6 is resistant to temperatures on the order of 300° C. and is preferably composed of a silicon-based polymer. Junction 6 is protected from the atmosphere of the furnace by insulating bricks.

Thermocouple 7 is provided to assure registration of the temperature and regulation of the temperature by plotter-regulator 8 which controls induction circuit 9.

The vacuum circuit includes furnace outlet 9, refrigerant 10, for example water, filters 11 for neutralizing the products which can exist in the form of flux in the metal or on the walls of the crucible, reservoir 18 and vacuum pump 19 connected to reservoir 18. An assembly is provided for measuring and regulating the vacuum in the reservoir. This assembly includes pressure indicator 20 and pressure regulator 21 which controls the pump 19. The vacuum in the reservoir can be, for example, on the order of two millibars. An automated valve 22 is used to place the reservoir in communication with the furnace. Spigot 23 is provided to make it possible to insulate the furnace.

The system for measurement and regulation includes a submerged hydrogen analysis electrode 15, a hydrogen partial pressure recorder 16 and a pilot valve 17 for regulating the automated valve 22. The pilot can include, for example, an inlet-outlet assembly, a calculator assembly, and a memory assembly. The pilot can be constructed using microprocessors and electronic clocks.

The parameters of the curve in FIG. 1 are introduced in the inlet-outlet assembly. These parameters are pressure $P_2$ at the end of phase 1, pressure $P_3$ at the end of phase 2, pressure $P_4$ at the end of phase 3, speed $V_1$ for phase 1, speed $V_2$ for phase 2, and speed $V_3$ for phase 3. The unit of time for measurement of partial pressure is $\Delta T$.

The calculator assembly receives the indication of actual variation of partial pressure in time $\Delta T$. This actual variation of partial pressure is represented by $\Delta P_r$. The calculator assembly also calculates the theoretical variation of the partial pressure to be obtained in the same $\Delta T$, where the theoretical variation of the partial pressure is represented by $\Delta P_t$, by the relationship:

$$\Delta P_t = V \times \Delta T$$

The calculator assembly compares $\Delta P_r$ and $\Delta P_t$ and controls the automated valve 22 such that valve 22 is closed if $\Delta P_r$ is greater than $\Delta P_t$ and valve 22 is opened if $\Delta P_r$ is less than or equal to $\Delta P_t$.

Figure 3:
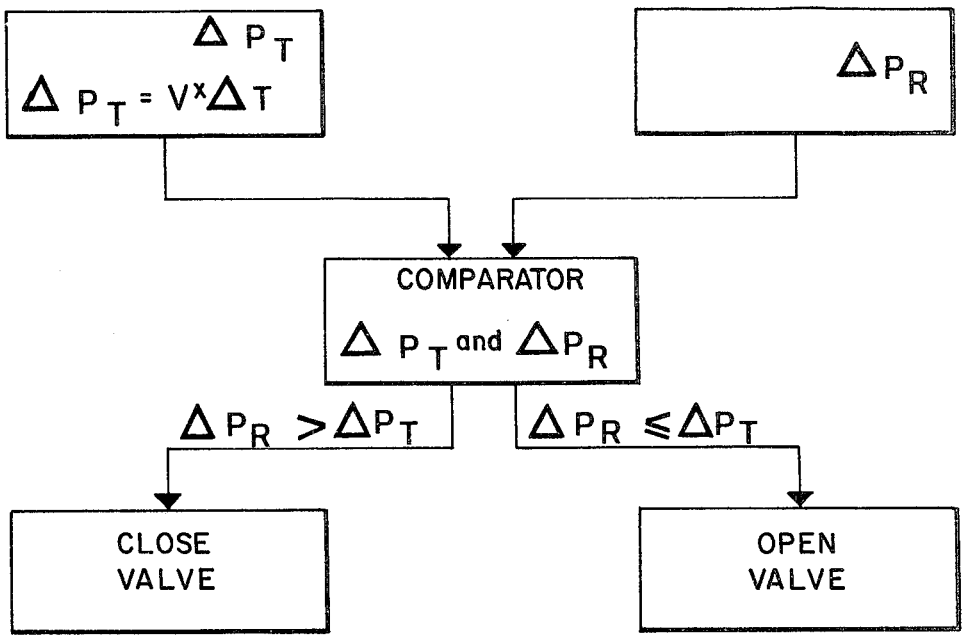
FIG. 3 is a schematic diagram illustrating the measuring and regulating method of the instant invention.

FIG. 3 illustrates the principle of the above-described regulation.

It should be noted that pilot 17 can receive information from several vacuum furnaces and regulate them as described above by means of automated valves 24, 25, and so on.

The memory assembly can receive all input indications without going through display. The parameters for each type of alloy and for each dimension of crucible are placed in the memory.

It is seen that the optimal vacuum may be obtained and controlled by the mere use of only these two parameters.

Examples of use of the above-described apparatus are as follows. Optimal curves to be placed in the memory for the different alloys can be determined by the following tests. These tests are merely examples of methods for obtaining these optimal curves.

Curves giving the partial pressure of hydrogen as a function of time are recorded and compared by obtaining results from two indicative tests. In the first test, an ingot of metal is removed from crucible 3 of FIG. 2 in a steel capsule 26 illustrated in FIG. 2. The ingot is solidified under two millibars by connecting container 27 to reservoir 18 where the ingot can solidify. Container 27 is provided with a glass cover 28 through which the solidification can be monitored. The following factors are to be monitored: (1) the time of appearance of the first bubbles; (2) the concavity of the surface; and (3) the density of the ingot.

Figure 4:
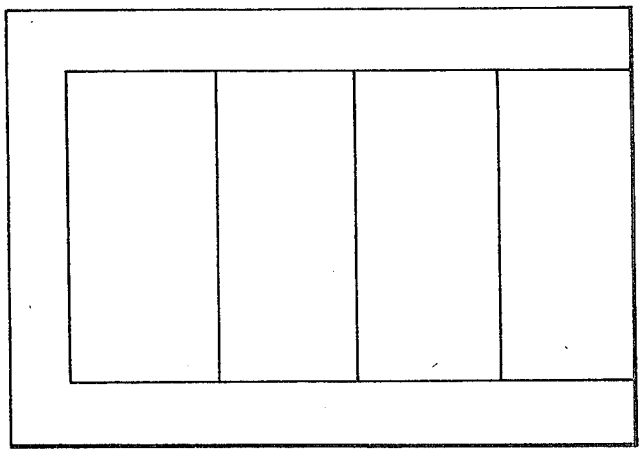
FIG. 4 illustrates a shelf plate having variable thickness shelves for use in obtaining degasification parameters in accordance with the instant invention.

In the second test, a shelf plate of, for example 200 mm by 200 mm, as illustrated in FIG. 4, formed by variable thickness shelves of, for example, 20.16.12.8.4 mm, is cast in a mold made of sand, preferably at low pressure. The plate is examined radiographically. A satisfactory metal must lead with an alloy AS 7606, for example, to microporacities:

of 0 level in ASTME 155 cliches for the 4 mm shelf

| | |
|---|---|
| ≦1 | 8 |
| ≦2 | 12.16.20 |

A possible degradation of the modification of the silicon should not appear except in the 20 mm shelf. The mechanical characteristics of different shelves are compared to the profiles of the curves.

The furnace can be fed with metal from a fusion furnace by a pump, for example an electromagnetic pump. The same means may be used for the evacuation of the metal after the degasification under vacuum has been accomplished, for example, towards the crucible of a low-pressure machine.

We claim:

1. A process for automating a degasification cycle for metal alloys under vacuum comprising:

automatically controlling the degasification speed to correspond to predetermined degasification speed parameters independently of the intervention of an operator during said controlling.

2. The process according to claim 1 wherein said metal alloy is an aluminum alloy.

3. The process according to claim 2 further comprising controlling said degasification speed to sequentially correspond to a plurality of sets of degasification speed parameters, each set of degasification speed parameters corresponding to a predetermined desired degasification speed.

4. The process according to claim 3 further comprising controlling said degasification speed by adjusting said vacuum.

5. The process according to one of claims 2 or 3 further comprising triggering the degasification speed to correspond to a different set of degasification speed parameters by sensing a series of predetermined partial pressures of hydrogen in said aluminum alloy.

6. The process according to one of claims 2 or 3 further comprising determining said plurality of sets of degasification speed parameters by registering a set of base cycles into which the degasification cycle has been broken down and by establishing the correlations existing between these registrations and the properties of an ingot solidified under vacuum and those of a test sample having shelves of different thicknesses.

7. The process according to claim 1 further comprising storing predetermined degasification speed parameters in a memory means.

8. The process as recited in claim 3, wherein said plurality of degasification speed parameters result in reduction of the gaseous percentage of said aluminum alloy to a predetermined non-zero percentage.

9. A process for automating a degasification cycle of aluminum alloys under vacuum comprising the steps of:

breaking down the degasification cycle into base cycles;

determining the degasification parameters associated with the various base cycles in the degasification cycle by registering the cycles and establishing the correlations existing between these registrations and the properties of an ingot solidified under vacuum and those of a test sample having shelves of different thicknesses; and adjusting the vacuum in a manner so as to assure the correspondence between the parameters retained and those actually obtained during the degasification cycle.

10. Automation process according to claim 9 characterized in that the degasification cycle comprises four base cycles:

Phase I—the metal passes into a partial hydrogen pressure $P_1$ beginning with a lower pressure $P_2$ with a fixed slow degasification speed, $V_1$.

Phase II—one passes from a partial pressure $P_2$ to a pressure $P_3$ at a speed $V_2$ more rapid than $V_1$ and fixed.

Phase III—one passes from the pressure $P_3$ to $P_4$ with a low speed $V_3$ fixed.

Phase IV—one maintains the metal with a null degasification speed, with a partial hydrogen pressure $P_4$.

11. Automation process according to any one of claims 9 or 10 characterized in that it consists of beginning the cycles by an analysis electrode submerged in the metal.

12. Automation process according to claim 10 or 9 characterized in that the metal is heated in an induction heat furnace.

13. A process for automating a degasification cycle for metal alloys under vacuum comprising:

(a) degasifying said metal alloy at a first predetermined speed when the partial pressure of gas in said alloy is between a first predetermined level and a second predetermined lower level;

(b) degasifying said metal alloy at a second predetermined speed when the partial pressure of gas in said alloy is between said second predetermined lower level and a third predetermined still lower level;

(c) degasifying said aluminum alloy at a third predetermined speed when the partial pressure of gas in said alloy is between said third predetermined still lower level and a fourth predetermined lowest level; and (d) maintaining an equilibrium gasification level at said fourth predetermined lowest level.

14. The process according to claim 13 wherein said metal alloy is an aluminum alloy.

15. The process according to claim 13 wherein said first predetermined speed is a slow speed, said second predetermined speed is a fast speed and said third predetermined speed is a slow speed.

16. The process according to claim 13 further comprising sensing the level of the partial pressure of gas in said alloy and initiating degasification at said first predetermined speed when a level of partial pressure of gas in said alloy equal to said first predetermined level is sensed.

17. The process according to claim 13 further comprising initiating degasification at said first predetermined speed when a signal from a sensing electrode submerged in said aluminum alloy is sensed.

18. The process according to claim 13 further comprising initiating degasification at said first predetermined speed when a sensing electrode senses a partial pressure of gas in said alloy equal to said first predetermined level.

19. The process according to any one of claims 16, 17, or 18 further comprising placing said alloy in an induction heat furnace.

20. The process according to claim 19 further comprising operating said furnace to maintain a substantially constant temperature in order to assure movement of liquid alloy metal to renew layers in contact with said vacuum in said furnace.

* * * * *